US008161684B2

(12) United States Patent
Pedersen

(10) Patent No.: US 8,161,684 B2
(45) Date of Patent: Apr. 24, 2012

(54) WINDOW SECURING MEANS AND METHODS

(75) Inventor: Torben Allesen Pedersen, Horsens (DK)

(73) Assignee: VKR Holding A/S, Horsholm (DK)

( * ) Notice: Subject to any disclaimer, the term of this patent is extended or adjusted under 35 U.S.C. 154(b) by 927 days.

(21) Appl. No.: 12/066,171

(22) PCT Filed: Sep. 6, 2006

(86) PCT No.: PCT/EP2006/008681

§ 371 (c)(1),
(2), (4) Date: Aug. 8, 2008

(87) PCT Pub. No.: WO2007/028590

PCT Pub. Date: Mar. 15, 2007

(65) Prior Publication Data

US 2008/0309099 A1 Dec. 18, 2008

(30) Foreign Application Priority Data

Sep. 7, 2005 (EP) ..... 05019477
Mar. 7, 2006 (DK) ..... 2006 00330

(51) Int. Cl.
*E05F 11/00* (2006.01)

(52) U.S. Cl. ..... 49/277; 49/146; 49/276; 49/278; 49/364; 49/379

(58) Field of Classification Search ..... 49/146, 49/277, 278, 276, 364, 379
See application file for complete search history.

(56) References Cited

U.S. PATENT DOCUMENTS

| | | | | |
|---|---|---|---|---|
| 2,363,021 | A * | 11/1944 | Steele | 335/229 |
| 4,879,842 | A * | 11/1989 | Bailey | 49/141 |
| 5,581,945 | A | 12/1996 | Baumle | |
| 2004/0093799 | A1 * | 5/2004 | Yoshikawa et al. | 49/192 |

FOREIGN PATENT DOCUMENTS

| | | | |
|---|---|---|---|
| CN | 2435493 | Y | 6/2001 |
| DE | 10303814 | | 8/2004 |
| DK | 168406 | B1 | 3/1994 |
| EP | 0792991 | A1 | 3/1997 |
| EP | 1445403 | A1 | 11/2004 |
| GB | 100996 | | 11/1965 |
| JP | 48-004194 | | 5/1946 |
| JP | 03-295991 | | 12/1991 |
| JP | 06-191279 | | 7/1994 |
| JP | 08-326394 | | 12/1996 |
| JP | 09-041775 | | 2/1997 |
| JP | 11-509285 | | 8/1998 |
| JP | 11-118236 | | 4/1999 |
| JP | 11-125049 | | 5/1999 |

(Continued)

*Primary Examiner* — Jerry Redman
(74) *Attorney, Agent, or Firm* — K. David Crockett, Esq.; Niky Economy Syrengelas, Esq.; Crockett & Crockett, PC

(57) ABSTRACT

An assembly for securing a hinged building window (11) in closed position relative to an aperature defined by a main frame (12). The assembly includes a compressible gasket disposed between the hinged building window (11) and the main frame (12) defining the aperature. The hinged building window (11) and the main frame (12) each includes a respective portion (20) of a magnetic means for securing the hinged building window said (11) to the frame (12), where the magnetic means for securing includes a two magnetic magnets that are magnetically attracted to one another.

10 Claims, 18 Drawing Sheets

FOREIGN PATENT DOCUMENTS

| | | | |
|---|---|---|---|
| JP | 2001-349149 | | 12/2001 |
| WO | WO9704206 | | 2/1997 |
| WO | WO0196699 | A1 | 12/2001 |
| WO | WO02053863 | A1 | 7/2002 |
| WO | WO03048487 | A1 | 6/2003 |
| WO | WO2004063498 | A1 | 7/2004 |

* cited by examiner

WINDOW SECURING MEANS AND METHODS

The present invention relates to ventilation devices, securing and/or locking devices and/or methods used, for example, but not exclusively, for a pivotably openable window or like closure member, the securing/locking devices and methods being of a type having a magnetic securing and/or locking force to secure and/or lock a pivotably openable closure member within a stationary aperture frame, such as a pivotable window sash within a stationary window frame.

BACKGROUND ART

Pivoting windows, doors or other aperture closure members are well known and are widely used in walls or ceilings or roofs of buildings, inter alia. A locking mechanism arranged at one or both edge of the sash of a window or other aperture closure member is often used to prevent the sash from being opened unintentionally.

In various previous instances, as is described for example in EP1445403 and WO0196699, locking systems for windows, doors, vehicle doors or the like, often included a movable locking member such as a pawl, a ratchet or the like, for cooperating with a striker plate, said striker plate having a recess, slot or the like for cooperating with the locking member in a locking position. To prevent break-ins etc., the locking member may often feature means for locking the locking member in relation to the striker plate, and said means, which may be a boss or an indentation, may have been designed to engage with a part of the striker plate. Other locking assemblies have also been described, as for example in WO03048487 or WO02053863 where a rotatable or swivellable handle has a locking member designed to pivotally engage a respective projection on a window frame or sash to lock the window in closed position.

Still further locking assemblies have included such as in WO04063498 which involves a lock assembly, especially for locking a window, a door or the like, comprising a base member, an operating member pivotally connected to the base member, a link member pivotally connected to the base member, a latch pivotally connected to both the link member and the operating member, said operating member being provided with a pivotable elongated handle bar having a first side facing the operating member. DK patent no. 168406 also discloses a lock assembly of the above type. A still further pivotable elongated handle bar lock actuating device is disclosed in EP0792991.

However, the designs of these or like prior lock mechanisms could be improved, particularly when it comes to ergonomics, and/or other effects on or undesirable results of manual manipulations in operation. Often, prior art designs have required the application of substantial manual forces to engage and secure or even to release the respective locking mechanisms thereof, particularly in those window constructions which include a resiliently compressible, hermetically sealing gasket provided between the frame and the sash or door. Such gaskets can require large forces for manipulation and/or can create a jarring, thus often disagreeable release effect to the operator. It is hence an object of the invention to provide a lock assembly having improved functionality with respect to ergonomics and simplicity in use.

Ventilation devices for use with doors or windows are often constructed with a first plate having a first series of apertures separated by bars and a juxtaposed second plate with a second series of apertures separated by bars. The first plate is slidable relative to the second plate to determine the amount of overlap between the first and second series of apertures, typically in a range between no overlap and complete overlap for regulating the amount of air flow through the ventilation device. U.S. Pat. No. 5,581,945 discloses a ventilation device of this type. Practical restrictions on this type of construction causes the surface area used for the bars to be as large as the surface area covered by the apertures. The maximum flow through area through the apertures in the full overlap position is therefore only half of the surface area of a ventilation channel or passage behind the plates. As a result, this type of ventilation device can for some applications provide the required maximum ventilation capacity. The plates are typically made from aluminum, and this type of ventilation device offers therefore only very little heat insulation. Also the air tightness between the juxtaposed plates can be an issue.

DISCLOSURE OF THE INVENTION

On this background, it is an object of the present invention to provide an openable closure member such as a door or window with improved ergonomic characteristics, particularly in alternately opening and then securing them in closed position. One or more of these objects may be achieved in accordance with an assembly by providing a window or other openable aperture closure member with a magnetic securing means and a method of operation thereof. Such a securing means eases the closing and securing process and/or contrarily simplifies the opening process.

Such a magnetic means may be made useful by a magnet which is cooperative with a magnetically attractive part (a part with a high magnetic permeability or another magnet) to alternately securely hold and release an openable part within a stationary frame, as for example, a pivotable window sash in a stationary window frame.

The closure member is provided with compressible gasket. The magnetic attracting force is larger than the gasket repulsion force, so that an positive effective closing force is created, and a user does not need to apply any substantial force to compress the gasket.

In addition to the magnetic securing means for securing the sash or door structure to the frame structure, a locking means for locking the sash or door structure to the frame structure may also be included.

A leverage mechanism may be provided to overcome the effective closing force.

It is a further object of the invention to provide a ventilation device with a higher flow through capacity and good heat insulation capacity. This object is achieved by providing a ventilation device for use with a window or door frame, said device comprising a ventilation channel, a ventilation channel closure member disposed inside the ventilation channel, said ventilation channel closure member being pivotally suspended from said ventilation channel for pivotal movement about a pivot axis between a closed position and an open position, said pivot axis being disposed substantially transverse to the direction of the air flow in said ventilation channel, said ventilation channel closure member comprises at least one axially extending elongated wing with an arc shaped face, and the radius of said arc being substantially equal to the distance between said arc shaped face and said pivot axis. Such a device has a high maximum flow capacity, good air flow control and heat insulation characteristics.

Further objects, features, advantages and properties of a pivot window and actuation members and/or securing and/or locking devices and the ventilation device according to the invention will become apparent from the detailed description.

BRIEF DESCRIPTION OF THE DRAWINGS

In the following detailed portion of the present description, the invention will be explained in more detail with reference to the preferred embodiments shown in the drawings, in which.

DETAILED DESCRIPTION

Figure 1:
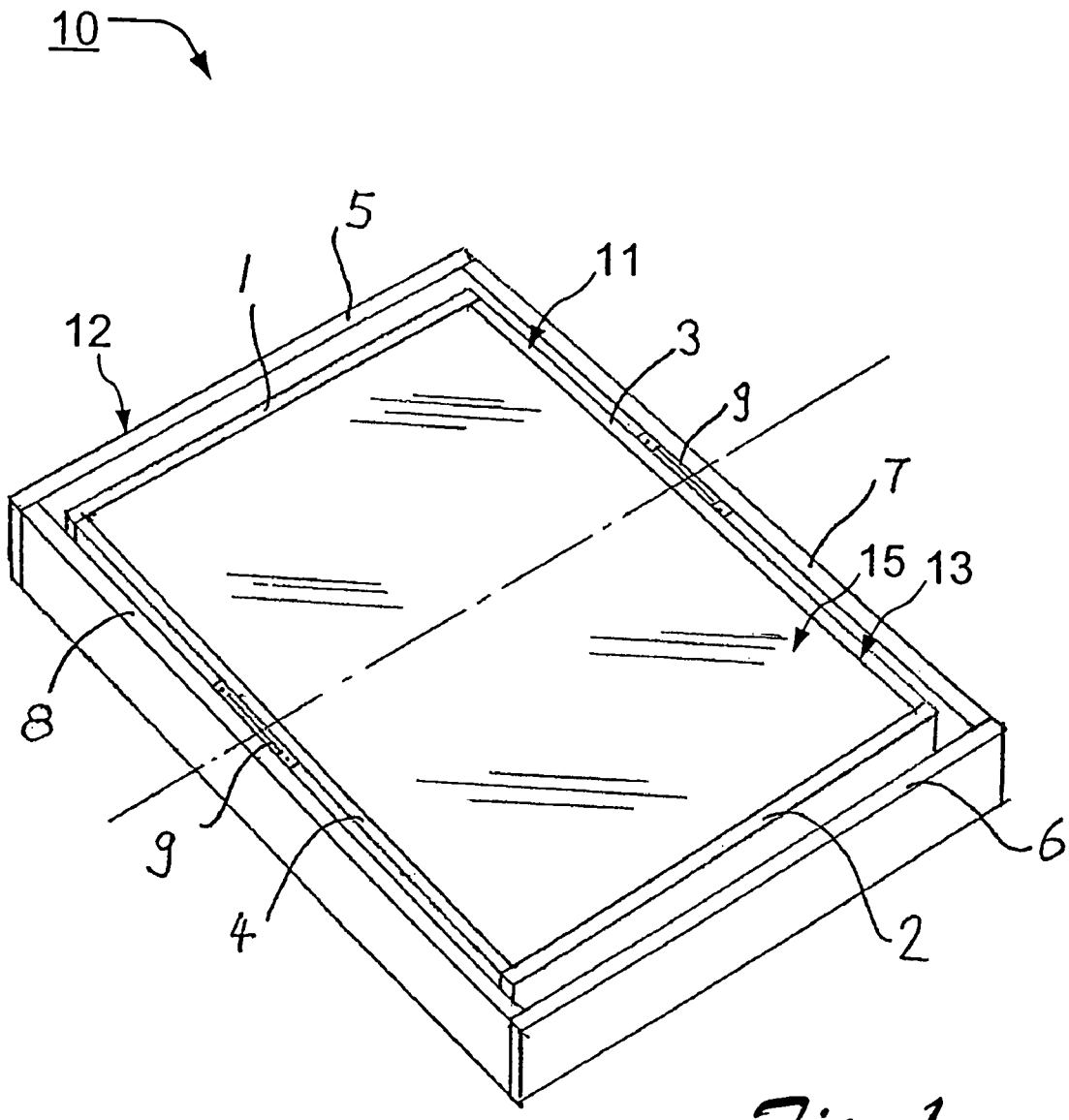
FIG. 1 is a schematic isometric view of an embodiment of a pivotal window hereof in a closed position, FIG. 2, which includes sub-part FIGS. 2A and 2B, provides further schematic isometric views of embodiments of one or more pivotal windows hereof in respective open positions.
Figure 2A:
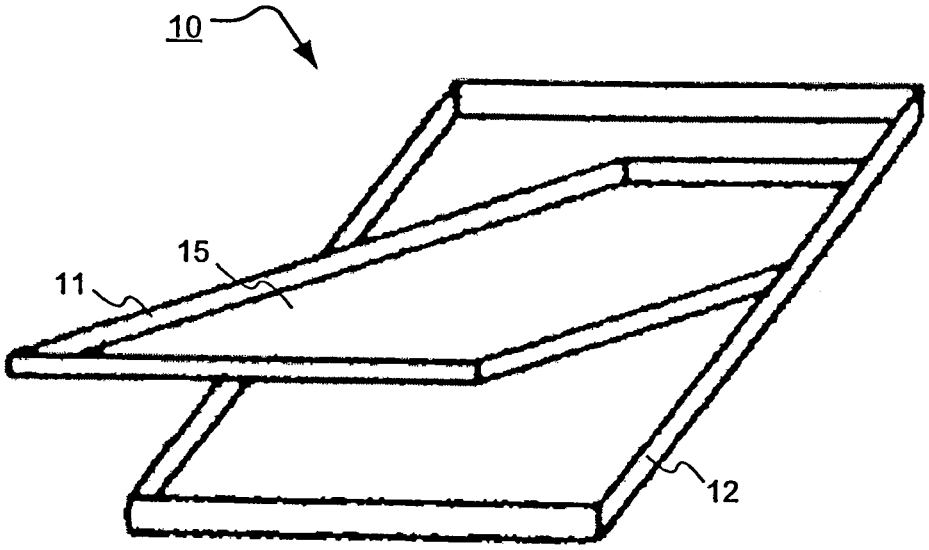
Figure 2B:
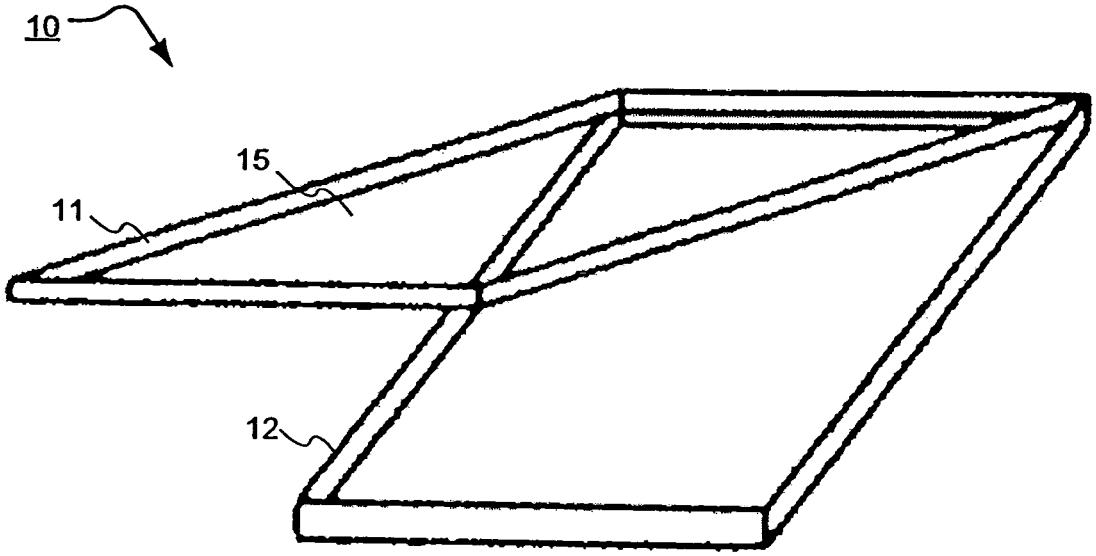

The present invention relates generally to securing devices or systems for an aperture closure member such as a window or a door (also car door), the primary securing systems hereof including a magnetic securing device or assembly. Such a magnetic assembly may generally include a fixed magnetic field element, such as a permanent magnet or an anchor, and a movable magnetic field element, such as a permanent magnet or an anchor, which cooperate to alternately, first, engage and hold or secure the aperture closure member in closing position of said aperture, and second release and allow for opening of the closure member relative to the aperture. The invention further relates to an overall combination of an aperture and aperture closure member, such as a window or a door, the aperture being defined by a substantially fixed frame and the aperture closure member being a movable means such as a movable sash, said combination further including a magnetic securing device or system for alternately securing and releasing the aperture closure member relative to the aperture, e.g. for opening and closing said aperture.

In the general embodiments shown in FIGS. 1-4, the combination or assembly of an aperture and an openable closure member therefor is generally identified with the reference numeral 10, the aperture being defined by a frame 12 and the closure member or window identified generally by the reference numeral 11. The combination 10 may be, as shown in the drawings according to a preferred embodiment of the invention, an openable window assembly 11 with a main, substantially stationary, or fixed frame structure 12 which includes a top member 5, a bottom member 6, and side members 7 and 8, and an openable sash structure 13 with a top member 1, a bottom member 2, and side members 3 and 4. The sash structure 13 carries a window pane 15 which together form the openable closure member 11 in the embodiments shown in the drawings.

By means of swing fittings or hinges 9, between the respective sash and frame side members 3, 4 and 7, 8; the sash structure 13 is pivotally journalled in the frame structure 12 with an axis of rotation which as shown, may be parallel with the top and bottom members and may be top or bottom hung or established substantially halfway (or at any other disposition) between them by means of the pivotal fittings 9. Moreover, as is known, the rotatable sash 13 may be alternatively (or even alternately; see FIG. 4 described below) journalled about alternate fittings 9 at or about the top or bottom members, or alternatively (or alternately) at a position at or about and/or parallel to the side members.

In a closed position, the sash 13 and closure member 11 are oriented substantially parallel with and are disposed within the window frame 12. In the closed position a securing and/or locking mechanism (alternatives of which being described further below) engages the sash 13 with the frame 12 to hold the sash 13 secure and/or locked closed relative to the frame 12. Note, in many preferred embodiments of window frames and corresponding sashes, a resilient and preferably circumferential gasket (not shown) is often provided between the frame 12 and the sash 13. The gasket is compressed when the sash is in the closed position in order to provide a substantially hermetic seal between the frame 12 and the sash 13.

Figure 3:
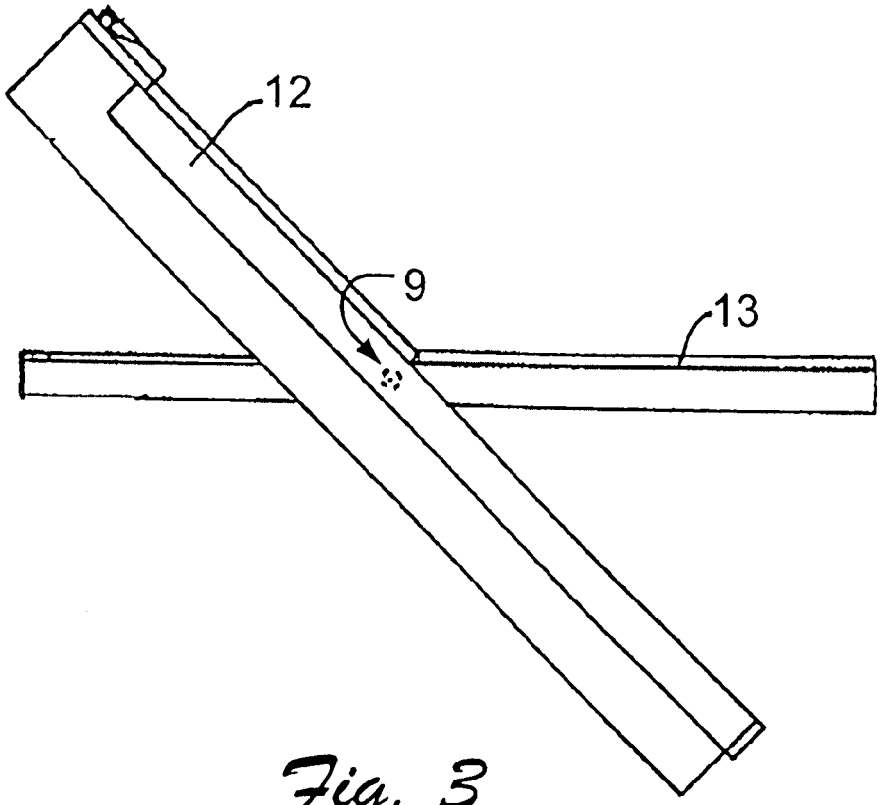
FIG. 3 is a side elevational view of a sash and a frame along the longitudinal dimension of an embodiment hereof.
Figure 4:
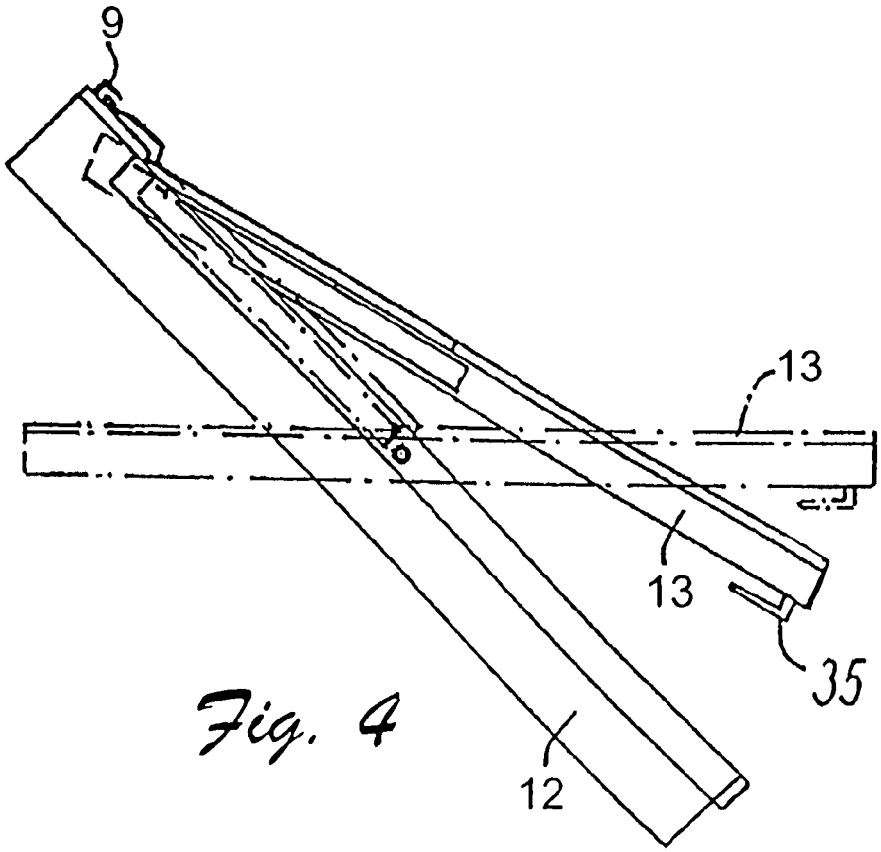
FIG. 4 is a side elevational view of a sash and a frame along the longitudinal dimension of an embodiment hereof.
Figure 5:
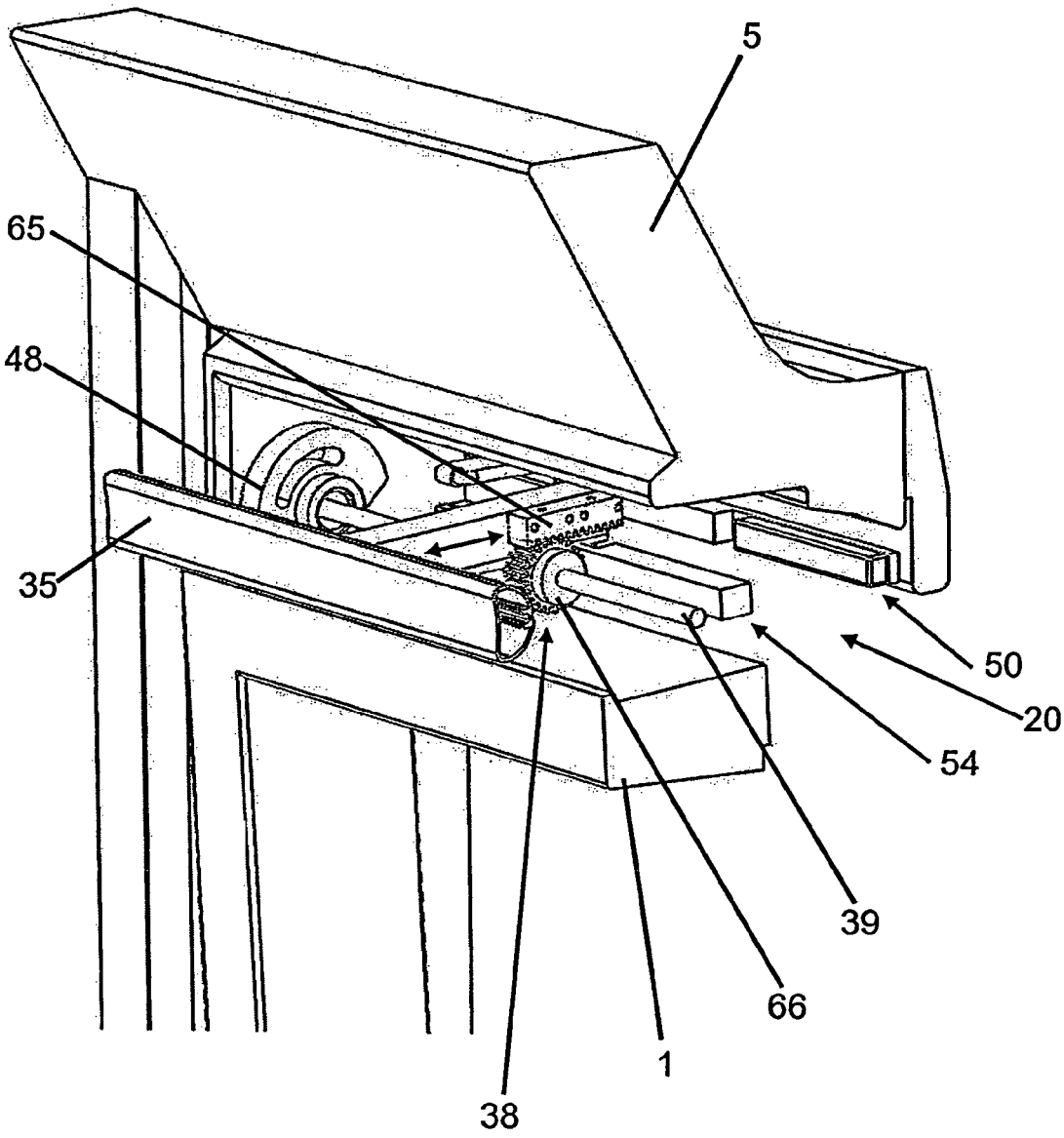
FIG. 5 is a partially cut open isometric view of a locking and/or securing assembly hereof in a window structure.
Figure 6:
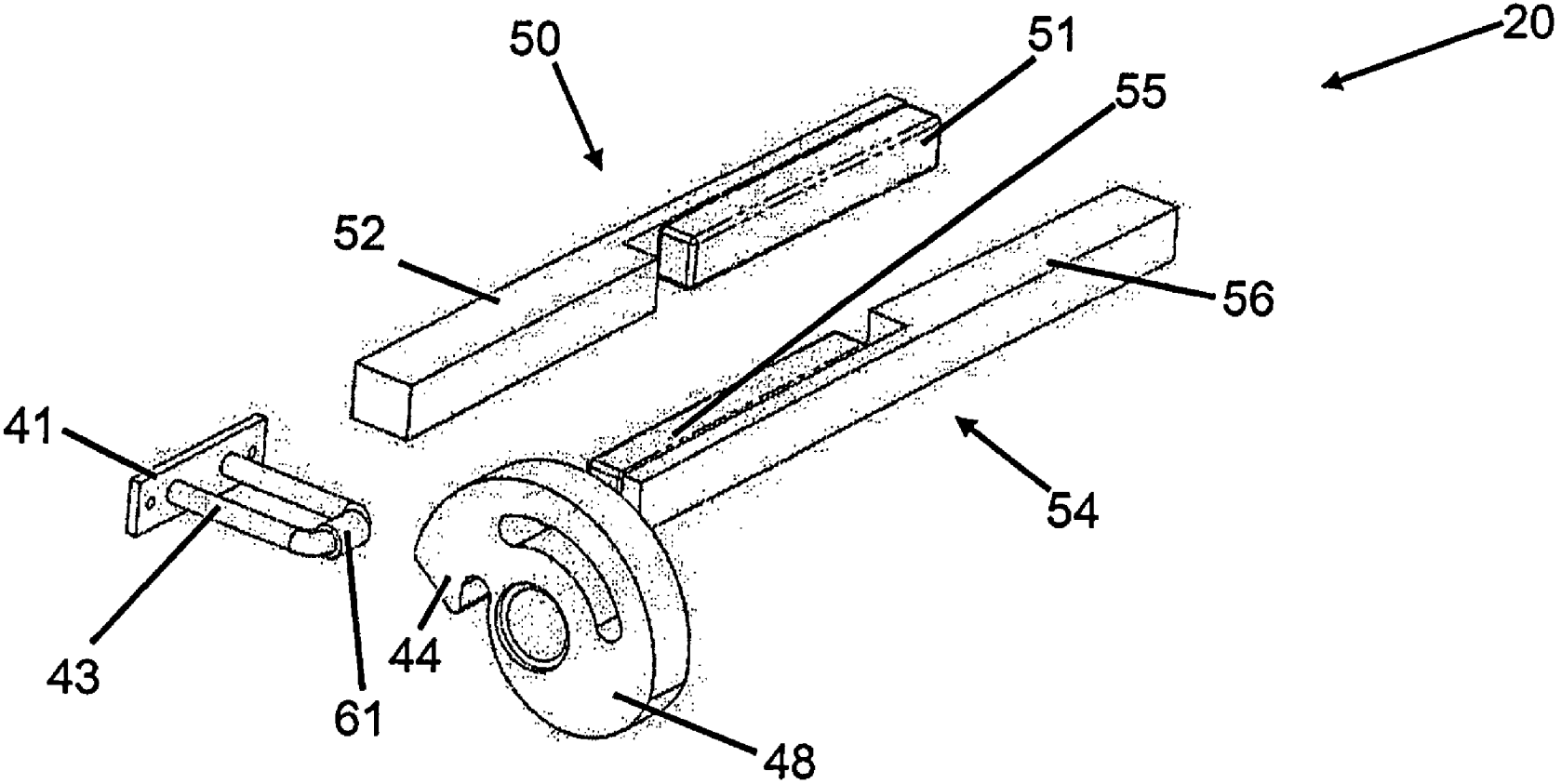
FIG. 6 is an isometric few of the essential components of a securing and/or locking assembly hereof.
Figure 7:
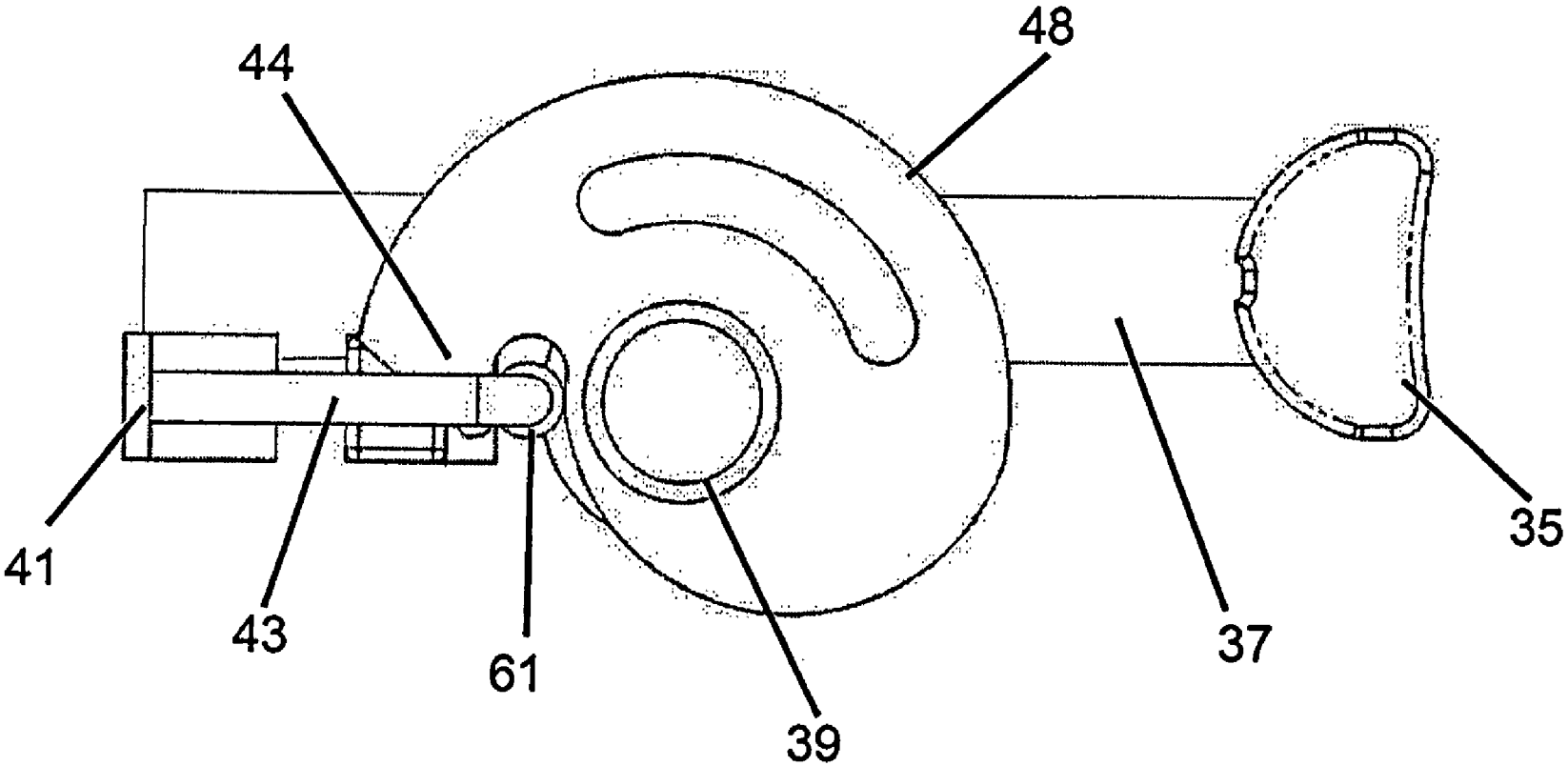
FIG. 7 is an elevational view of a securing and locking assembly according hereto in a closed position.

In FIGS. 3 and 4, schematic side views of the window assembly 10 as a combined turn/pivot window are shown, in which the sash structure 13 and the window/closure member 11 under normal use may be either top-hung or substantially centrally pivotal relative to the frame structure 12, or alternately both. Thus, both pivotal positions are shown in dashed lines in FIG. 4, with the central alternative shown in a solid line in FIG. 3. In either case, it may be that the window/closure member 11 may function as a pivot window which is manually openable and closable through use of a handle member here shown, FIG. 4, represented by handle bar 36 on the interior side of the sash bottom member. Note, the handle bar 36 may be top or bottom or otherwise situated.

To make it possible to swing the window sash through a large angle (e.g., as much as approximately 90 or even 180 degrees) to a convenient open position, the sash structure 13 may be pivotally connected with intermediate hinge members 9 often positioned substantially centrally between the upper and lower parts of the sash and frame side members 3, 4 and 7, 8, respectively. Note, during normal use of the window, either the top-hung or centrally-disposed hinges may be used (as alternatively could bottom disposed hinges or hinges disposed in the respective top and bottom members 1, 2 and 5, 6). The axis of rotation of the substantially central swingable connection lies approximately halfway between the top and bottom members in the same manner as shown in FIGS. 3 and 4, and operation of the window to this pivot or swing movement is carried out in a manner frequently used in connection with roof windows, inter alia.

Note, the handle assembly 35, as shown in the drawings, see FIGS. 3 and 4, may be disposed in a substantially horizontal disposition, i.e., operably parallel to the top and/or bottom members 1, 2 and 5, 6 of the sash and frame, and may be disposed at or adjacent the top members 1, 5 (not shown), or may be disposed at or about or adjacent the bottom members 2, 6 as shown in FIGS. 3 and 4. Note also, though not shown (and perhaps less preferred), the handle bar assembly 35 could be disposed at various dispositions top to bottom horizontally, or the handle bar member 35, or the like could be disposed in a lengthwise position parallel with the side members 3, 4 and 7, 8, and adjacent one or the other sides 3, 7 or 4, 8. Even so, it should be noted that these alternatives may have a variety of functional distinctions or restrictions not required or impacted by the preferred top and/or bottom horizontal dispositions shown and initially described here.

The handlebar assembly 35 may act not only as a maneuvering device for the movable sash 13, i.e., alternately into open and closed positions but also as an actuator for alternately engaging and disengaging the locking/securing device.

Unshown alternatives could provide for the handle bar assembly to be connected to the frame 12 for actuating the locking/securing device, but would likely lose functionality for maneuvering the sash and aperture closure 11 open and closed.

A first feature of a push/pull member 35 is in a first preferred interaction thereof with one or more locking or securing devices or assemblies hereafter referred to generally using the reference numeral 20. Details of such alternative locking or securing devices or assemblies 20 will be addressed below; but first; more description of a preferred push/pull handle bar assembly 35 will be described with particular reference to FIGS. 5-10, inter alia.

A feature of a locking or securing device or assembly hereafter referred to generally using the reference numeral 20 involves magnetism. Details of such will be described with particular reference to FIGS. 5, to 9. As shown in FIGS. 5-9, a magnetic securing means is depicted. One, two or more of such units may be provided along the sides of the frame 12, depending on the size and rigidity of the frame 12 and movable sash 13. The depicted preferred embodiment includes two such assemblies. Each assembly may be a magnetic securing device/assembly 20 including a magnetic unit 50 and a cooperating magnetic unit 54 to be affixed (as by screws, nails, embedding or other means) to a corresponding fixed frame member, e.g., either top or bottom frame member 5 or 6. The fixture may have, for example, a magnetic unit 50 including a super magnet in the form of a bar magnet 51 made from or at least including Neodymium-Iron-Boron ($Nd_2Fe_{14}B$). The bar magnet 51 is disposed on a substantially L-shaped member 52 of a magnetically permeable material such as iron to effectively form a U-shaped magnetic unit with both poles facing in the same direction. The magnetic device 20 includes similar or magnetic unit 54 with a super magnets in the form of a bar magnet to 55 disposed on a substantially L-shaped member 56 of a magnetically permeable material. The two magnetic units are arranged such that opposite poles face one another. The magnetic units 50,54 are embedded in plastic (not shown), preferably in a layer of plastic or similar suitable material that is a few millimeters thick. Thus, in the closed position the one another facing surfaces of the two magnetic units 50,54 are separated by a layer of plastic, i.e. a medium with a low magnetic permeability. Thereby, it is avoided that the two super magnetic units 50,54 come in direct contact with one another, which is important since it would require excessive forces to separate the two super magnetic units once they are in direct contact with one another. Fastening means such as bores for receiving screws (not shown) are integrated into the plastic embedding. The alternative of using less strong magnets that are allowed to come in contact with one another (and can subsequently be separated without applying excessive force) is not viable. In order to obtain and effective closing force that exceeds the repulsion force of the gasket throughout the compression force of the gasket it is necessary to use very strong super magnets, that have a substantial pulling power in a range that covers the complete compression range of the gasket (cf. FIG. 10).

An eyelet 43 or other hook receiving portion is disposed connected to the frame fixture 41 (or may otherwise be connected to the window frame) for receiving a securing hook 44, or the like, also described below. The eyelet 43 is provided with a roller 61 that cooperates with a cam 48 that will be described in greater detail below.

Thus, the magnetic units or portions 50, 54 overcome the repulsion force of the gasket and secure the aperture closure member 11 in closing position of said aperture.

The specific operational features of a preferred magnet assembly 20, which may also be known as a magnetic securing device 20, will now be described.

In operation, starting from an open position, the closure member is manually moved towards the closing position. When closure member abuts with the gasket, the attractive force between the magnetic units 50,54 (cf. FIG. 10) is larger that the repulsive force of the gasket under compression and the last part of the closing movement of the closure member is automatic or at least requires very little effort. In the closed position the closure member 11 is, in this embodiment, secured, but not locked, e.g. if the closure member is a window or a door of a car, a house or other building to prevent a burglar from opening the closure. In the preferred embodiment the assembly is configured such that the effective closing force (magnetic attractive force minus the gasket repulsion force) is relatively small, preferably only large enough so as to ensure that variations caused by production tolerances do not lead to a negative effective closing force. Thus, the effort required to move the closure member 11 from the closed position to an open position is as low as possible.

The magnetic force of the magnetic device 20 may be such as to strongly resist opening, thus locking the sash against the frame, or may in be of limited strength (depending upon available materials, for example) and thus provide more relative securing of the sash against the frame. An auxiliary or alternative locking device, e.g., a hookpiece 44, may then be used as described below. In any case, the mere push and pull activation by manual maneuvering of the handle bar 35 to put the magnetic units 50,54 in position adjacent one another may provide greater simplicity in operation and actuation of the alternate securing/locking and then unsecuring/unlocking feature, simplifying the overall maneuvering necessary by the human operator to both engage and disengage, and/or improving the overall ergonomics of the opening and/or closing of the closure member 11 relative to the aperture.

According to a preferred embodiment, the positive effective securing locking force is quite substantial, if not enough to lock the sash to the frame for burglary prevention. A leverage mechanism actuated by the handle bar 35 and including one or more cams 48 (two cams in the preferred embodiment) assists in overcoming the effective securing force (FIG. 10) when the closure member is to be moved from the closed position to an open position.

The preferably elongated handle bar 35, which has one or more, here two, connecting bars 37 which operably connect the bar to the cams 48. Such mechanical parts include generally as shown in FIGS. 5-9, one or more, here two, gear assemblies 38, which are mechanically connected to an elongated rotational rod 39. The gear assemblies include a rack 65 attached to the connecting bar 37 and a pinion 66 mounted on the elongated rod 39. These parts, particularly the gears 38 may then be connected (as by nails or screws or other connection means) to the sash, see e.g., elongated horizontal sash member 1*a* or 2*a* (which could be a part of or comprise the entirety of the sash upper or lower member 1 or 2, see descriptions thereof above). The connecting bars 37 are disposed to move translationally back and forth within (e.g., telescopically in and out of) the gear assemblies 38 (see the arrowheads in FIG. 5) with alternate pushing and pulling forces applied to the bar 35. The rotational rod 39 may be disposed in rotational capacity within a receiving trough or other channel like feature (not shown) defined in the sash member 1*a* or 2*a*.

The cams 48 are mounted onto of a elongate shaft 39 (at or near the opposite ends thereof) and rotate in unison therewith. In the closed position (FIG. 7) the cam 48 abuts with the roller 61 at the lowest point of the cam profile. This part of the cams 48 is also provided with a latch or hookpiece 44. In the closed position the latch or hookpiece 44 engages the eyelet 43, thereby effectively locking the closure member to the frame.

Note, as introduced, an auxiliary locking device may be used, e.g., for redundancy or to provide actual locking if the magnetic member 20 is not sufficiently strong to lock (e.g., rather than merely secure) the aperture closure member in closed position by itself. As shown in FIGS. 5, 6, 8 and 9, the magnetic securing device 20 may be used with an auxiliary locking device, particularly a latch or hookpiece 44, thereby providing a secure stay device plus a lock device. The auxiliary locking member or mechanism, 44, can thus be an integral part of the cam 48, although it would also be possible to provide attach one or more separate arms or hooks to the elongated shaft (not shown), i.e. latch 44 may be operated by conventional means so long as it is adapted to extend into a recess or eyelet 43 connected to or within the frame 12 as for example in either upper or lower member 5 or 6 (or in the respective side member 7 or 8) to secure the sash against undesired opening.

Note also that it may be desirable for there to be clearance between the hookpiece 44 and the eyelet 43 such engagement of the hook with the eyelet only occurs when and if the magnetic securing force has overcome, as by an attempted break-in. Thus, so long as there is such clearance, then, the normal operation of the mechanical locking system will not have to overcome contact resistance of the latch. In another version there may not be any clearance between the hookpiece 44 and the eyelet to avoid rattling or noise when the closure member moves e.g. by wind forces. However the contact pressure between the hookpiece 44 and the eyelet 43 is configured to be very relatively small, so that the operation of the leverage mechanism is still very light. Thus, the system will be more ergonomically attractive, i.e., will require less manually-applied force for opening or closing.

Note, when a sealing gasket (not shown) is used as a sealing member between the frame and the sash, a considerable amount of force can often be necessary to be applied to and/or by a securing mechanism, such as may be necessary for use of a magnetic locking device 20 as shown and described here, to ensure that the gasket is properly and fully compressed for sealing closure. In the closed position, the contrary repelling force of the gasket that resists closure or otherwise urges the sash toward an open position (caused by the resilient pressure of the gasket exerted by the gasket on the sash 13) is fully counteracted by the magnetic attractive force between the magnetic units 50, 54. (i.e. the mechanical lock, including e.g. the latch 44, is preferably not loaded at any time by the force caused by the compressed gasket). In operation, the magnetic lock first overcomes the pressure of the gasket and thereafter, if used, the hookpiece 44 may be used to catch the eyelet 43 when the sash is secured in closed position by the magnet. When the sash is opened, the order is reversed, so that the latch 44 may be disengaged from the eyelet 43 whilst the magnetic securing means still withstands the opening force exerted by the gasket onto the sash. The effective closing force is then overcome after the latch has disengaged the eyelet. The profile of the cam 48 assures that there is a substantial leverage effect on the (pulling) force that the user applies to the handle bar 35. Consequently, the force that a user needs to apply to the handle bar to alternately engage and disengage and engage the sash is very low, thus adding to user ergonomics and/or comfort. As will be readily understood other leverage mechanisms with or without a cam could be used, such as for example a mechanism with the elongated shaft 39 acting as a synchronous shaft on between two racks, one of the racks being connected to the handle bar via the connecting bars and the other rack being connected to a push bar, the extremity thereof acting on the frame.

Figure 8:
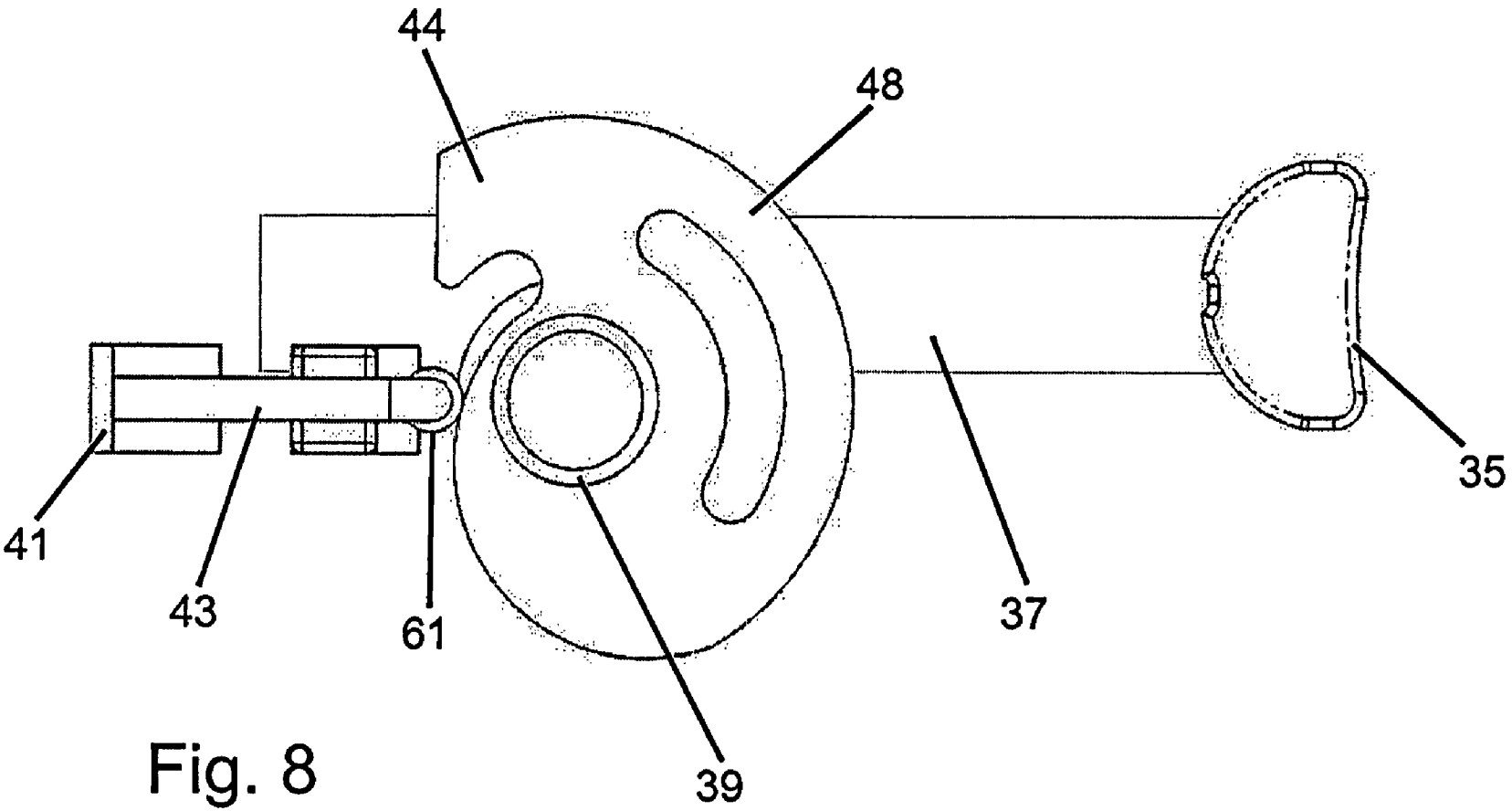
FIG. 8 is an elevational view of a securing and locking assembly according hereto in a position in which the mechanical locking mechanism is disengaged, whilst the magnetic securing system is not.
Figure 9:
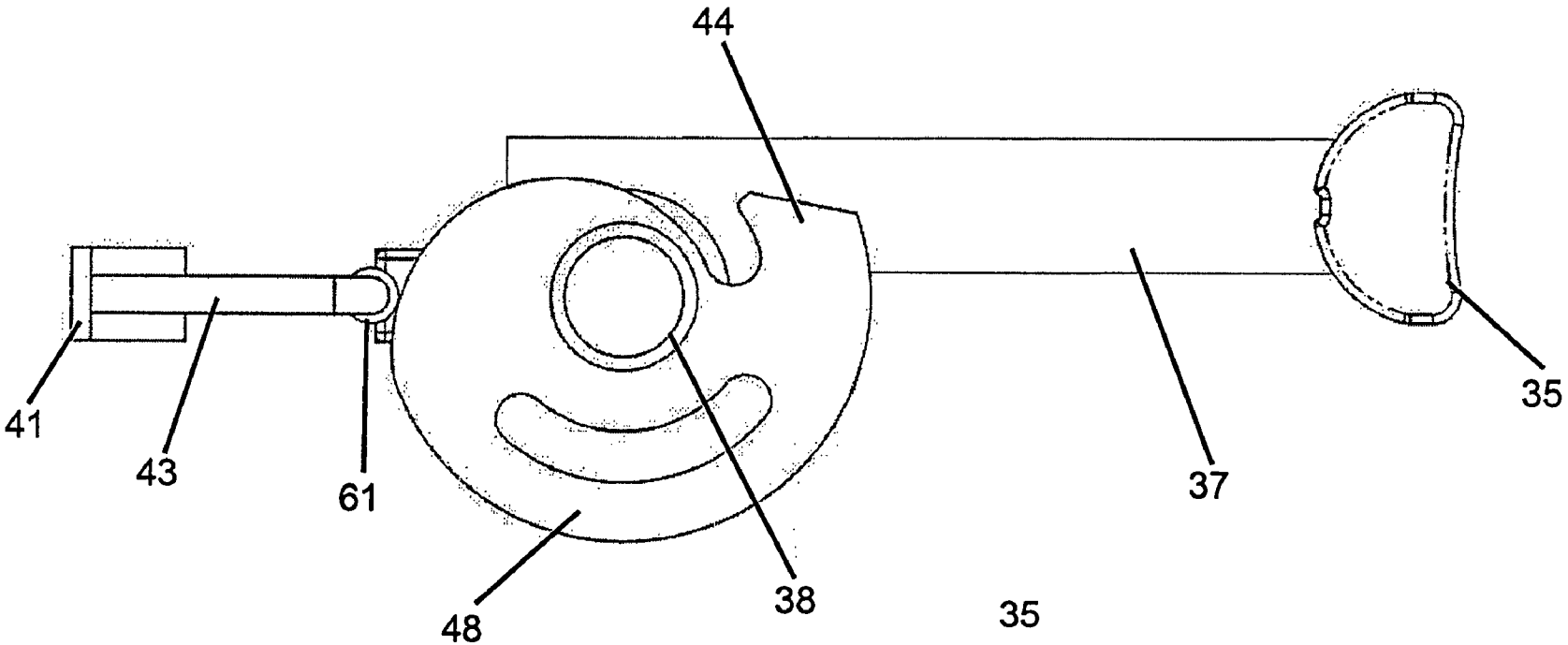
FIG. 9 is an elevational view of a securing and locking assembly according hereto in a position in which both the mechanical locking mechanism and the magnetic securing means are disengaged.

FIG. 8 shows the assembly in a semi-open position where the cam is acting on the roll 61 to overcome the last part of the effective closing force, whilst FIG. 9 shows the assembly in an open position in which there is no longer any effective closing force.

Figure 10:
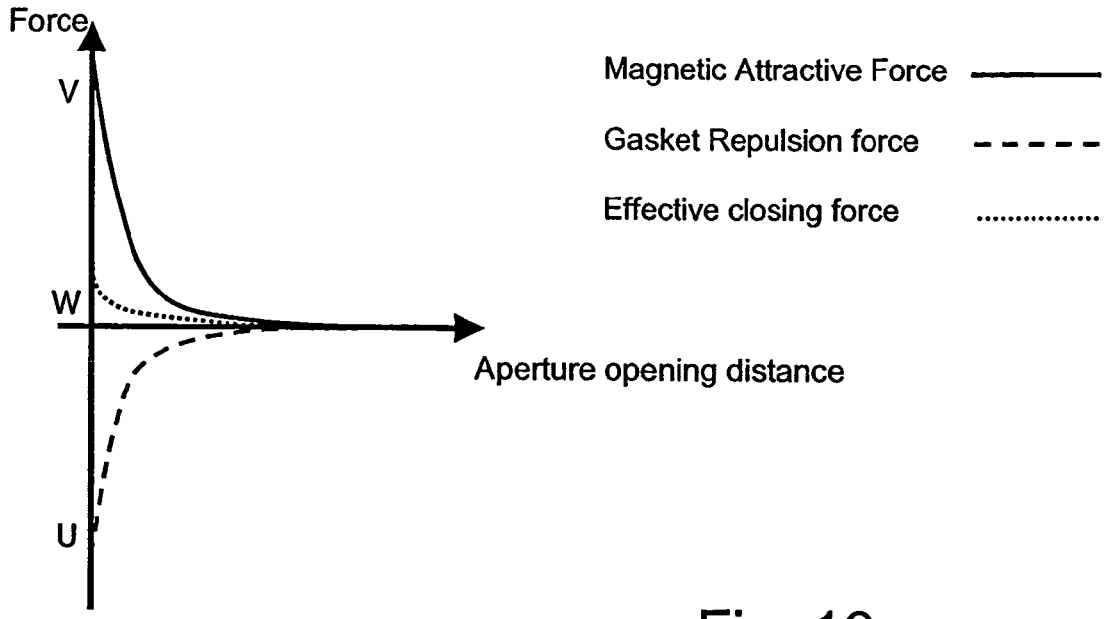
FIG. 10 is a graphical representation of force versus distance according hereto.
Figure 11:
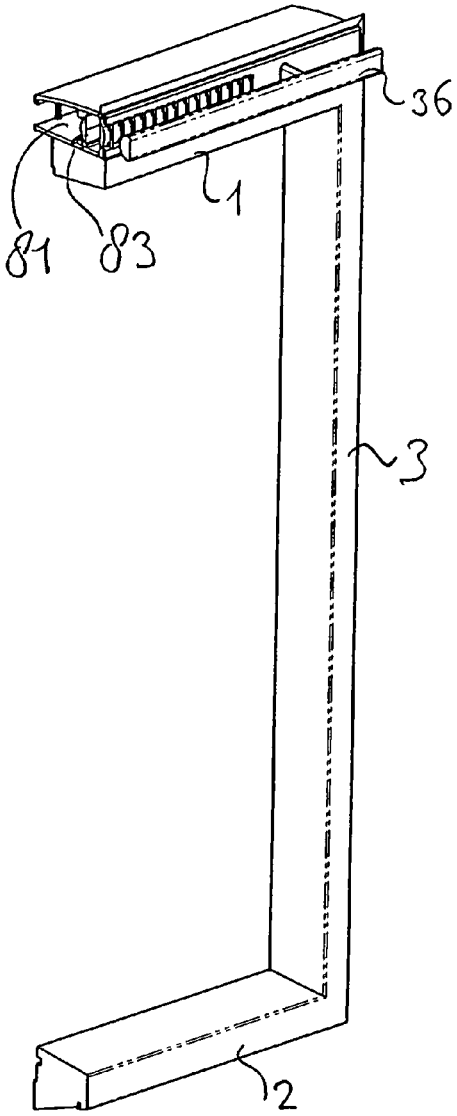
FIG. 11 is an elevated cutaway view of a securing and locking assembly according another embodiment of the invention.
Figure 12:
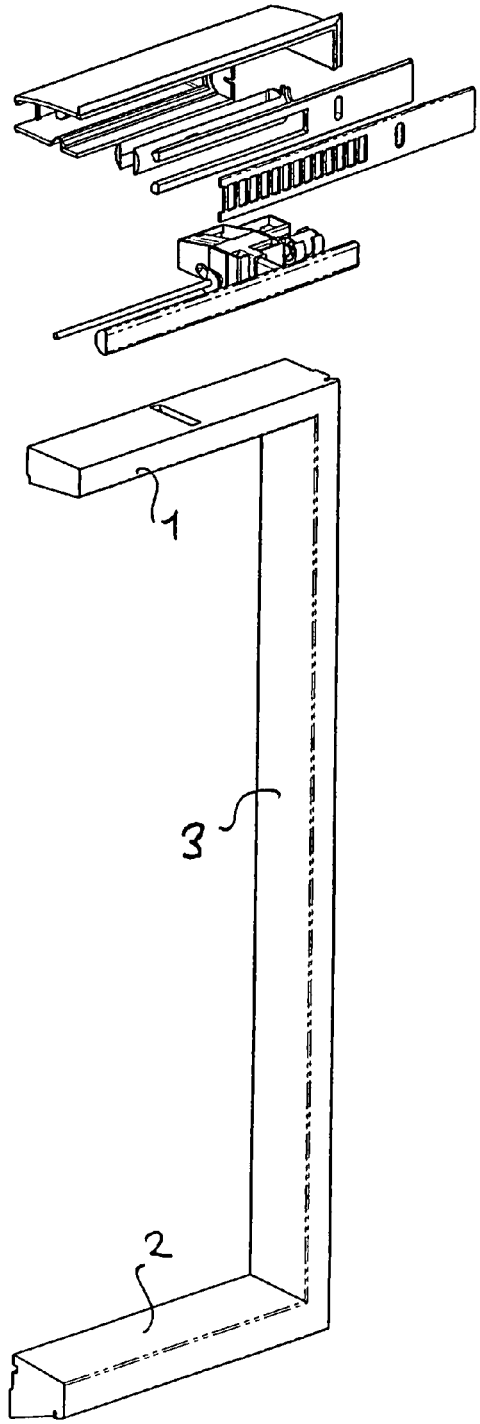
FIG. 12, is the view of FIG. 11 in an exploded version.
Figure 13:
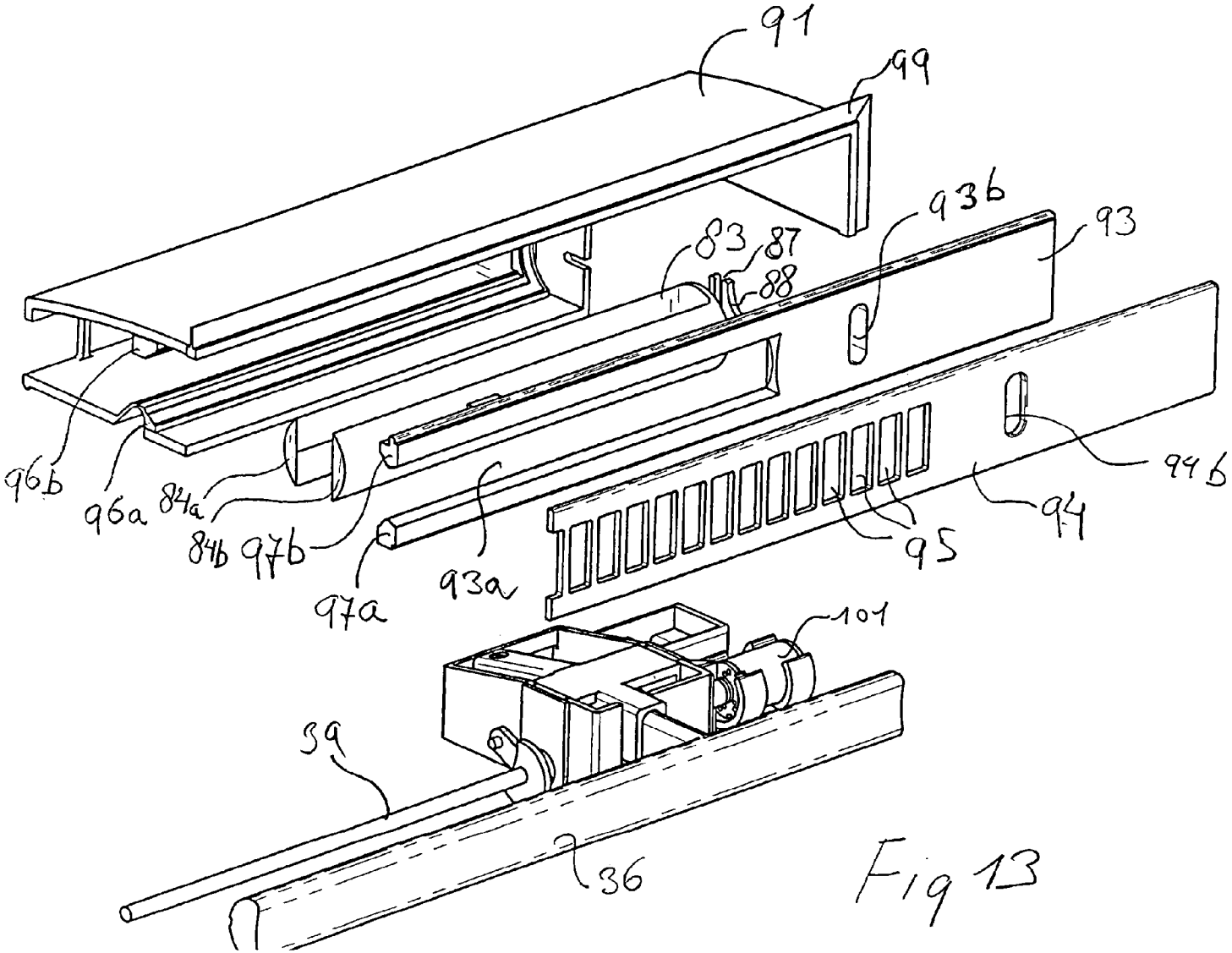
FIG. 13 is a view in detail on a part of FIG. 12.

A graphical representation of an embodiment of an operable magnetic force versus a gasket force is set forth in FIG. 10. In this representation, a gasket force line L is shown graphically as a dashed line, while the magnetic force line is shown in solid line form. On the abscissa is the Aperture Opening Distance starting at the left side at A which represents closure of the aperture at zero distance (i.e., substantially zero distance between the sash and the frame) extending to a point B which is where the gasket force drops to zero representing an open aperture condition (i.e., where the gasket is removed from contact with sash. On the ordinate is the measure of force. Point U represents the maximum closure-resistive force of the gasket, which may be empirically determined and point V represents the amount of closure force of the magnet. Preferably, the magnet 20 will be chosen to have a closure force at least equal but preferably slightly greater than the gasket force (otherwise, the gasket will successfully open the aperture against a lesser magnetic force). The resulting effective closing force is represented by the dotted line, and the effective window closing force is represented by point W.

FIGS. 11 through 18 show another preferred embodiment of the invention. In this embodiment the rack and pinion mechanism in the leverage mechanism for transforming the translative movement of the handle bar 35 into a rotational movement of the cam 48 has been replaced with a reel 71 (FIG. 18) that is mounted on shaft 39. Two flexible elongate members 73 are wound to the reel 71 and extend therefrom in opposite directions. The ends of the two flexible elongate members 73 are secured to the reel 71, for example by a bead (not shown) at the extremity of the flexible elongate members 73 received in axial slots (not shown) in the reel 71. The two flexible elongate embers 73 can in be formed by one piece of material that approximately in the middle of its longitudinal extension is fixed to the reel. The flexible elongate members 73 can be made of various suitable materials e.g. any material that will typically be used in precision transmission belts, such as wires, cords, cables, ropes, wires, bands, ribbons, belts, chains or combinations thereof. Preferably, the flexible elongate members 73 are formed by a strip of glass fiber fabric. The other extremities of the flexible elongate members 73 are secured to one of the at least two connecting bars 37 and slightly tensioned so that there will be little or no backlash between the handle bar and 35 and the shaft 39.

The part of the sheet forming one of said elongate flexible members 73 is formed by a strip on a transversely inner portion of the sheet. The other of the elongate flexible members is formed by two strips formed by two transversely outer portions of the sheet. The aperture 73' between the two transversely outer portions has a width slightly larger than the width of the transversely inner portion of the sheet. The one elongate flexible member passes though the aperture formed between the two transversely outer portions of the other elongate flexible member.

In this embodiment the sash 11 is provided with a ventilation channel 81 in the top bar 1 where the leverage mechanism is also disposed. The ventilation channel 81 connects the front of the sash 11 to the rear of the sash 11 and the ventilation channel 81 can be opened and closed by a ventilation channel closure member 83. The ventilation channel closure member 83 has a cylindrical outer shape with a central slab of the cylinder removed. The removed slab forms a passage for the air with two wings 84*a* and 84*b* with a cross sectional shape in the form of a circular segment flanking the passage. The arc of the curved outer surface of the wings 84*a* and 84*b* has a radius that substantially corresponds to the distance between the curved outer face and the axis about which the closure member rotates. The axis about which the channel closure member rotates extends transversely to the through flow direction of the ventilation channel.

The curved outer face of the wings 84*a* and 84*b* are in sealing contact a rear lower gasket 96*a*, a rear upper gasket 96*b*, a front lower gasket 97*a* and a front upper gasket 97*b* that all extend along the length of the ventilation channel closure member 83. The gaskets 96*a*,96*b*,97*a*,97*b* can be fine brushes, plastic foam strips or a metal or plastic strip with a tight fit with the wings.

Figure 14:
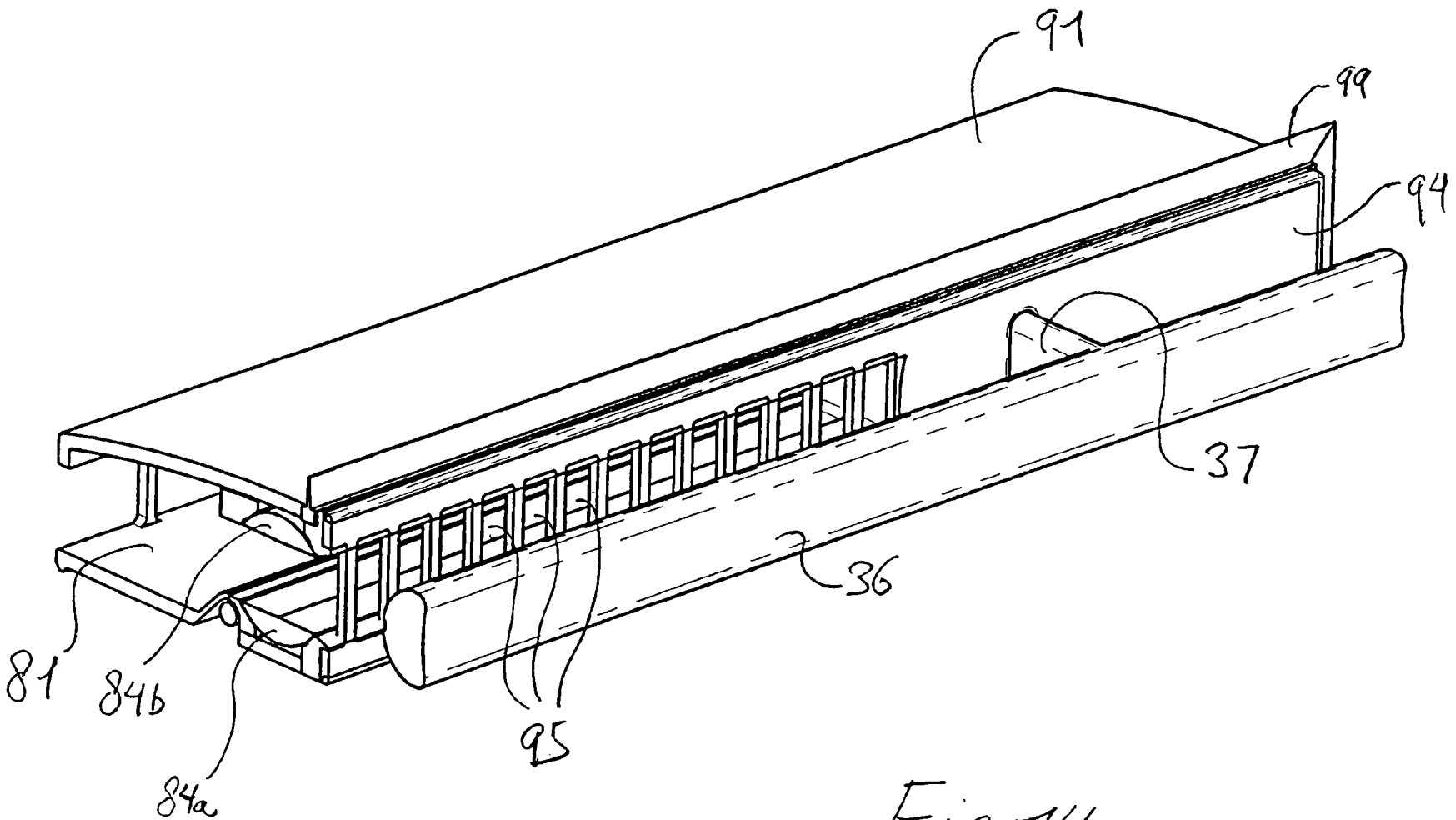
FIG. 14 is a sectional view in detail on a part of FIG. 11 with a ventilation channel closure member in an open position, FIG. 15 the same view as FIG. 14 with the ventilation channel closure member in a closed position.
Figure 15:
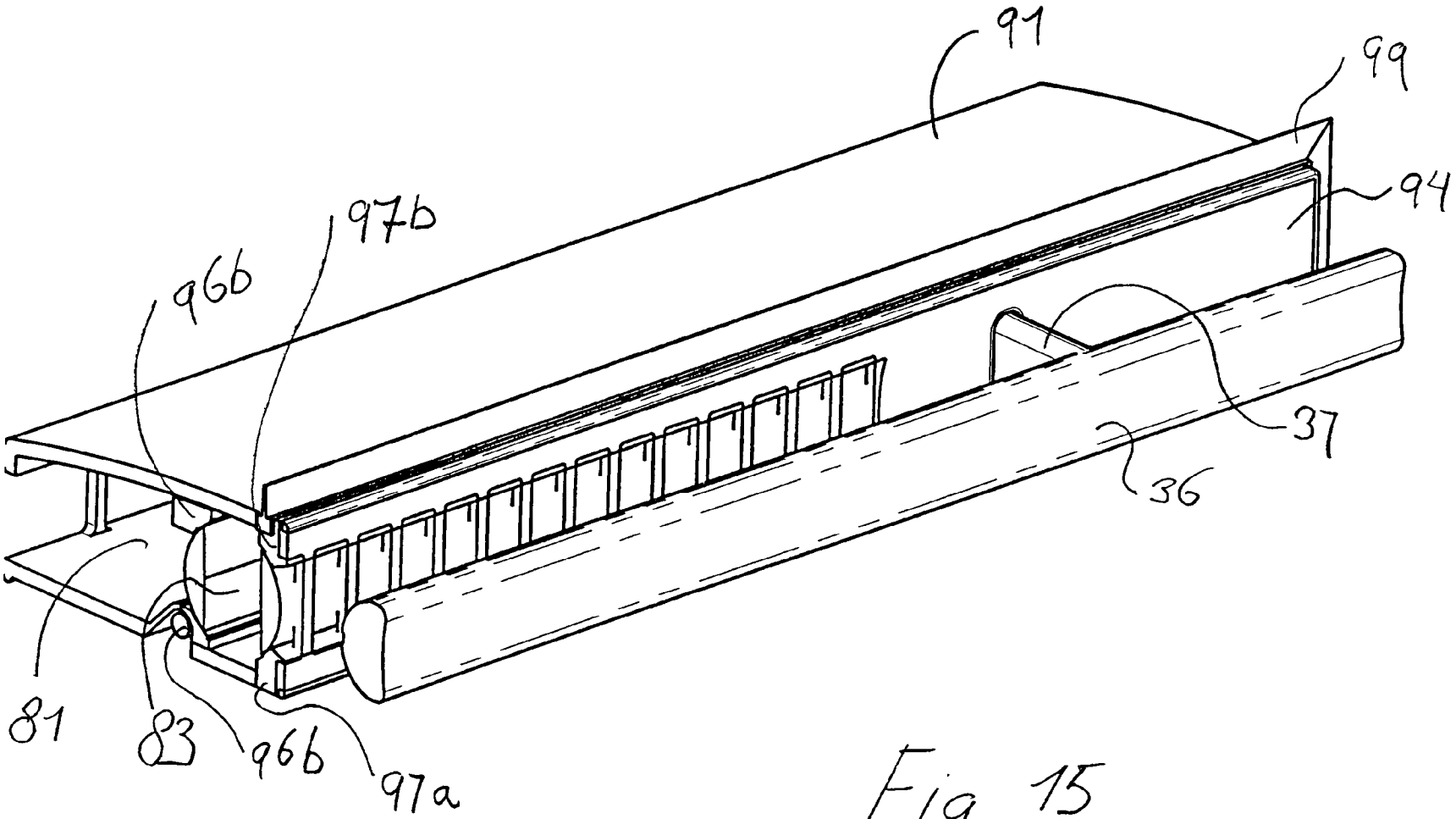
Figure 16:
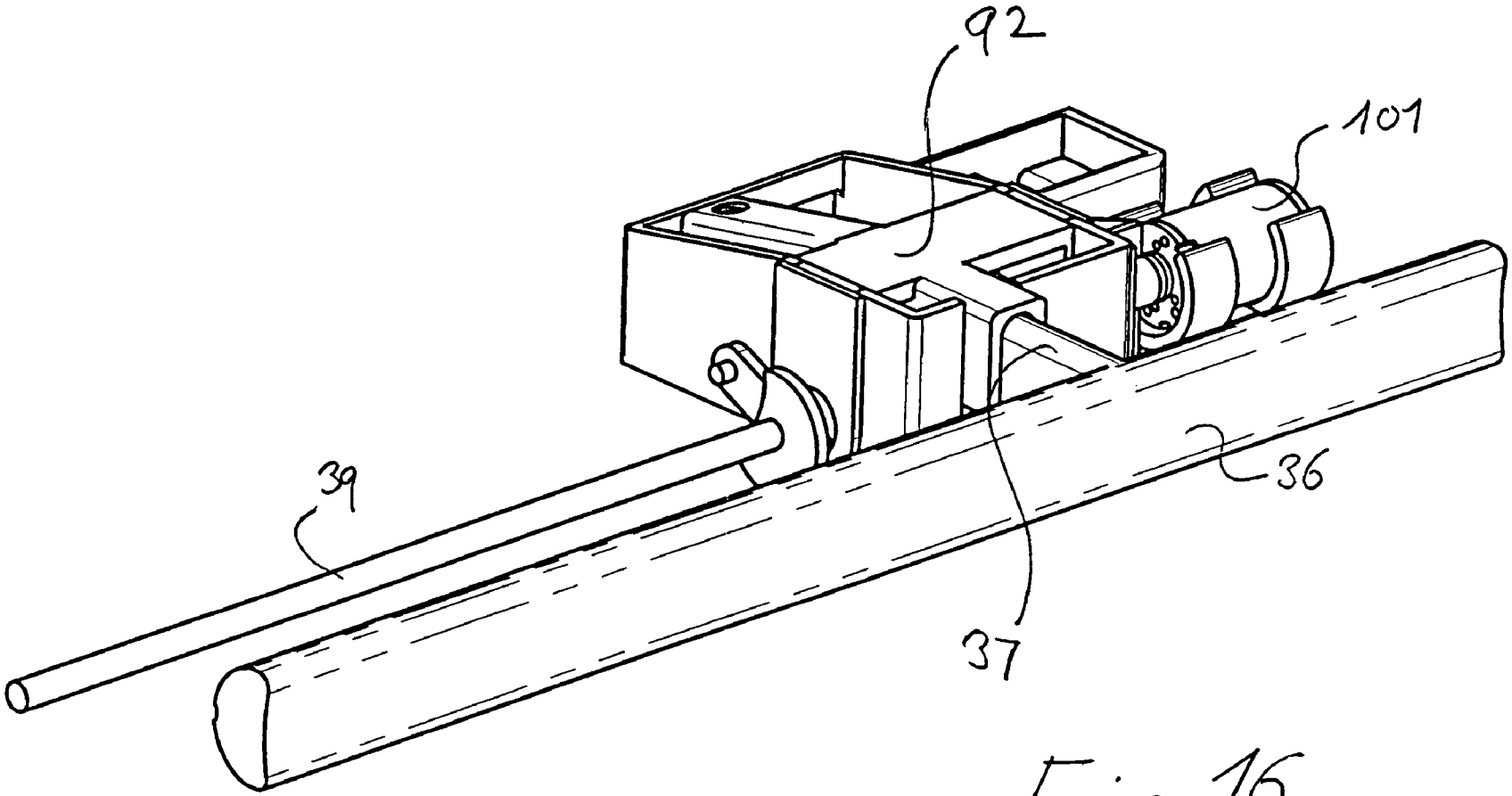
FIG. 16 is an elevated view of an actuation assembly with an electric drive motor of the securing and locking assembly of FIG. 11.
Figure 17:
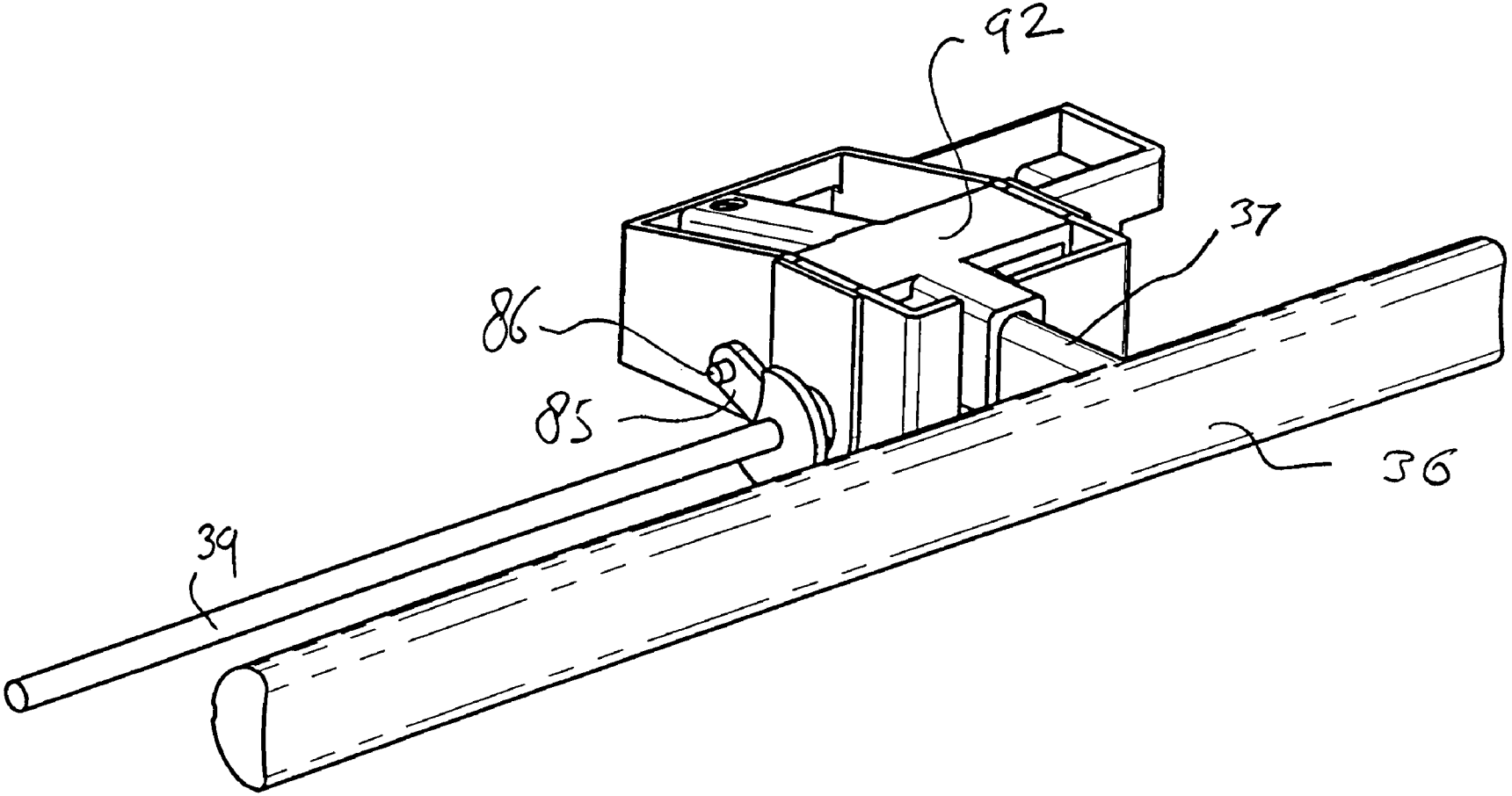
FIG. 17 is an elevated view of an actuation assembly without an electric drive motor of the securing and locking assembly of FIG. 11, FIG. 18 an elevated view of the mechanism inside the actuation assembly of FIG. 17
Figure 18:
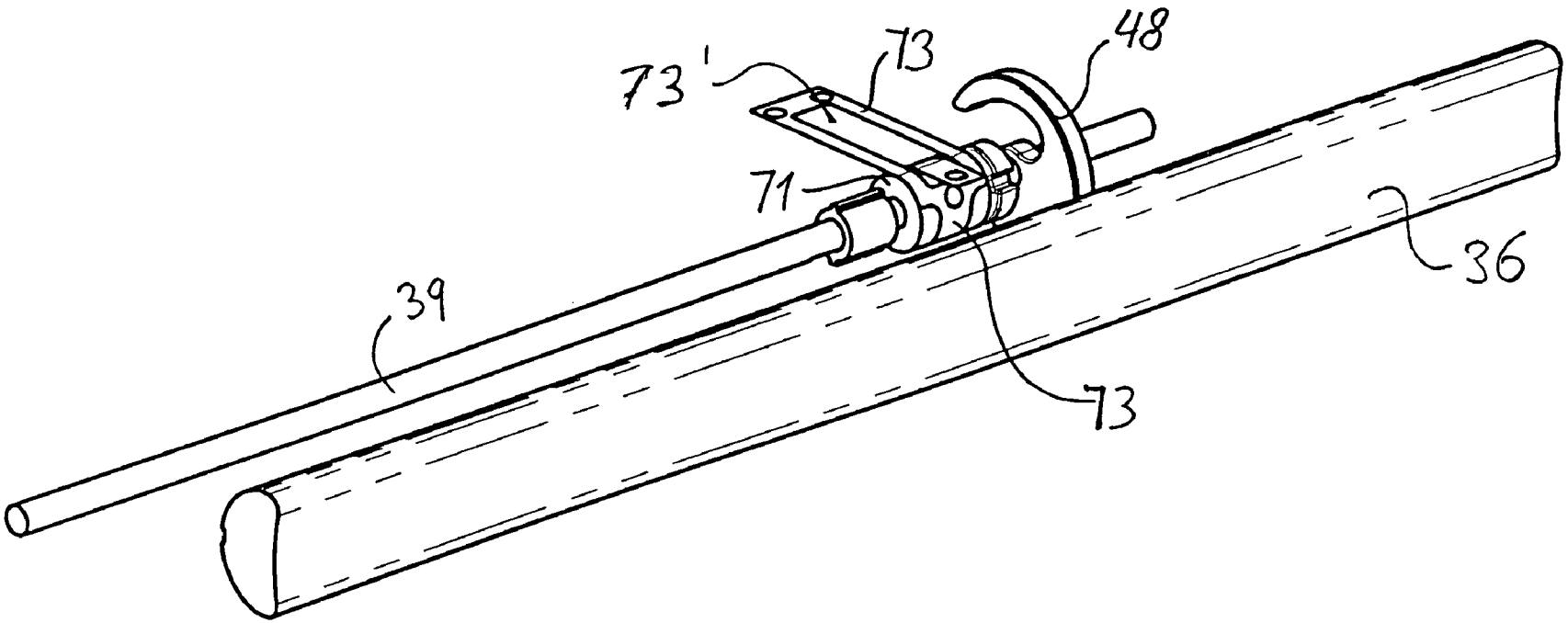

The ventilation channel closure member 83 and can be rotated about its longitudinal axis between an open position illustrated in FIG. 14 and a closed position illustrated in FIG. 15. Hereto, the shaft 39 is provided with an arm 85 that rotates with the shaft in unison. A peg 86 projects from the side of the arm 89 near the free extremity of the arm. The peg 86 engages a radial slot 87 in a plate 88 that is attached to the ventilation channel closure member 83. Thereby, the ventilation channel closure member 83 is operably connected to the handle bar 36 so that the ventilation channel 81 will open when the handle bar 36 is pulled by an operator and wherein the ventilation channel 81 is closed when the operator pushes the handle bar 36.

The arm 89 and the radial slot are arranged such that the ventilation channel closure member 83 is in its closed position when the handle bar 36 is in its most retracted position. The openable member 11 will in this position of the handle bar 36 be secured to the main frame 12. During the first part of the movement of the handle bar 36 from the retracted position to an intermediate position the openable member 11 (sash) is secured to the frame 12 whilst the ventilation channel closure member 83 makes its opening movement. The intermediate position (not shown) can be in any position between the completely retracted position and the completely extended position of the handle bar 36, and is preferably slightly closer to the completely retracted position than to the completely extended position.

When operator pushes the handle bar 36 back from the intermediate position to the retracted position the ventilation channel closure member 83 moves back to its closed position.

When the operator pulls the handle bar 36 from the intermediate position to the extended position the ventilation channel closure member 83 remains in its open position and the closure member 11 is released from the main frame 12 and the window can be opened by the operator.

When operator pushes the handle bar 36 back from the extended position to the intermediate position the closure member 11 is secured to the frame.

The actuating mechanism and the ventilation arrangement are received in an elongated hollow housing 91 that is mounted on the top of the upper member 1 if the sash 11. At its front, the hollow housing is provided with an inner cover plate 93 that is provided with a large slot 93*a* that is flanked by the upper and lower front gaskets 97*a* and 97*b*. The inner cover plate 93 is also provided with an oval aperture 93*b* through which the connecting member 37 passes. An outer cover plate 94 is mounted on the inner cover plate 93. The outer cover plate 94 is provided with a series of small slots 95 that overlap the large slot 93*a* in the inner cover plate. The series of small slots are be separated by narrow bars, thus providing a large area in the series of slots for air passage. A gasket 99 for sealing abutment with the window frame 10 extends from the edges of the cover plate 94.

The actuating mechanism can be provided with a drive motor 101 operably connected to the shaft 39 to assist the operation of the actuation of the closing an ventilation mechanism. The drive motor 101 can also be configured to act completely independently from the activation of the handle bar on command from a remote controller (not shown).

According to a further embodiment (not shown) the drive mechanism with the gear assemblies can be used in combination with the ventilation channel and the rotatable ventilation channel closure member.

Figure 19:
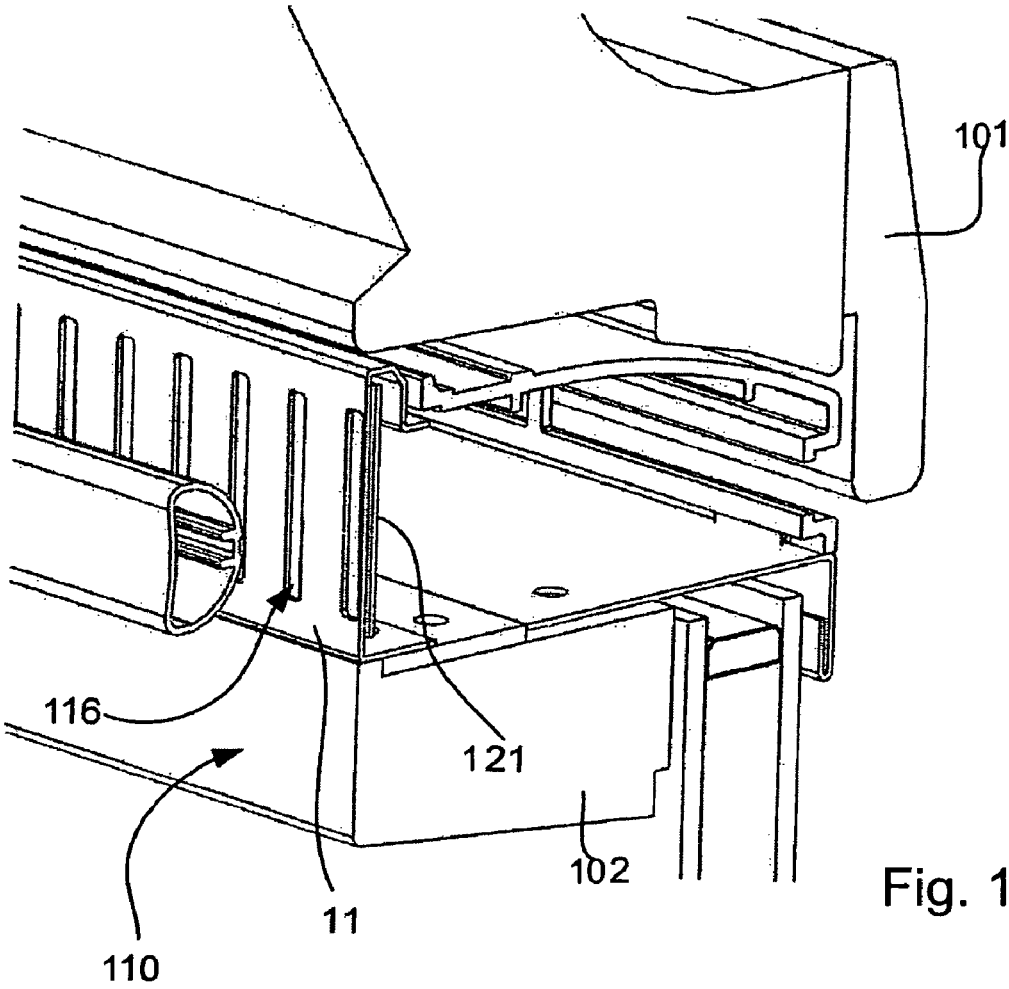
FIG. 19 shows, a cross-sectional view of a securing and locking assembly according another embodiment of the invention with a a ventilation device.

FIG. 19 shows a detail of a window locking device according to another embodiment of the invention in connection with a frame 101 and a sash 102. In the sash a ventilation device 100 is mounted such that air may pass from the outside to the inside, or vice versa, when the ventilation device is in a ventilating position. The locking assembly with the ventilation device 100 may be mounted in any suitable part of any building structure other than a window, such as a door.

The ventilation device 100 comprises two plates 111 and 121, of which the first plate 111 is connected in a stationary manner with the sash 102. The first plate 111 has a first set of apertures 116 formed as transversely extending slits. The second plate 121 is slidably connected with the first plate 111 by appropriate guide means accommodating longitudinally extending side edges 122 and 123 of the second plate 121, cf. FIG. 20. Furthermore, the ventilation device 100 is mechanically coupled to the operating bar 36 via linkage mechanism (not shown). Such lineage means connect with the second plate 121.

Figure 20A:
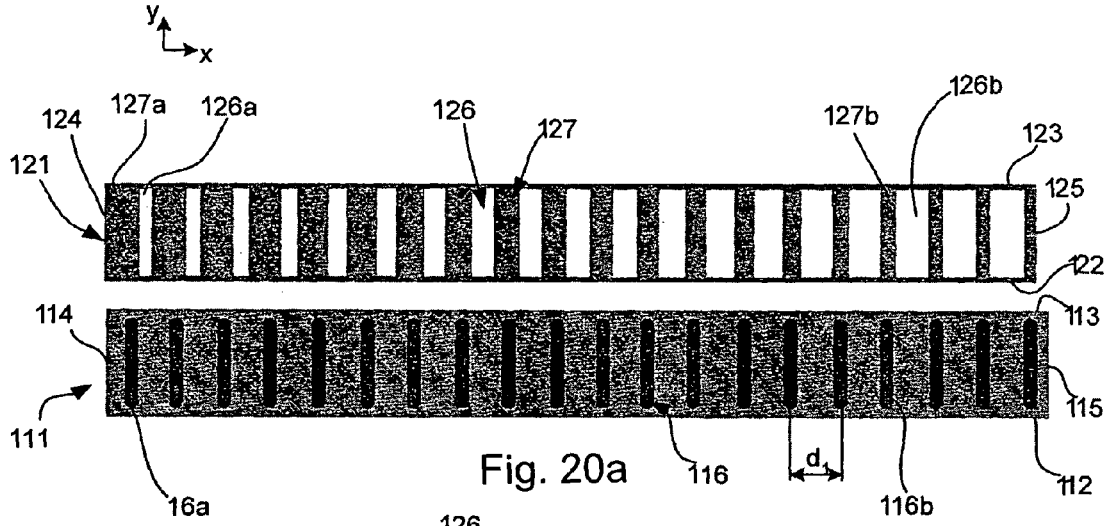
FIGS. 20*a* to 20*c* show plan views of an embodiment of two plates of the ventilation device of FIG. 19 in a first extreme position, an intermediate position and a second extreme position, respectively.

With reference to FIG. 20*a* the first plate 111 is formed as a substantially rectangular plate of any suitable material, e.g. aluminum. The first plate 111 has its longer side edges 112, 113 extending in the first direction x, in the embodiment shown the longitudinal direction of the ventilation device, and shorter end edges 114, 115 extending in a second direction y perpendicular to the first direction, i.e. here the transverse direction. The first plate 111 is provided with a first set of apertures 116 formed as oblong apertures positioned in a row extending in the longitudinal direction x of the first plate 111 substantially from one edge 114 to the other 115, each aperture 116 extending in the transverse direction y substantially from one edge 112 to the other 113. The distance between two adjacent apertures 116 is denoted d1. These apertures may instead of rectangular, circular or oval shape. The apertures are formed in any suitable manner and may e.g. be punched out of the plate.

The second plate 121 is provided with a second set of apertures 126 separated from each other by cover portions 127. In the embodiment shown in FIGS. 3*a* to 3*c* the cover portions 127 all have a substantially rectangular shape, the width of the cover portions 127 decreasing from the left-hand end edge 124. As a consequence of this configuration, the width of the second set of apertures 126 and thereby the aperture area increases from left to right. In the embodiment shown, the cover portions 127 are configured in such a manner that all of the apertures 116 are covered in a first extreme position shown in FIG. 20*a*. That is, the second plate 121 has cover portions 127 at positions corresponding to the distance d1 of the first plate 111. However, it is also conceivable to form the plates in such a manner that some apertures of the first plate are un-covered in all positions of the ventilation device. Furthermore, it should be noted that all directional indications such as "right", "left", "up", "down" etc. are purely arbitrary. The ventilation device may be mounted in any suitable manner in the window frame structure.

When operating the ventilation device 100, the second plate 121 is slid along the longitudinal direction x. In FIG. 20*a* two arbitrary apertures 116*a* and 116*b* of the first plate 121 have been marked. In the closed position shown, these apertures are covered by cover portions 127*a* and 127*b*, 1 respectively. If the second plate 121 is slid a short distance only to the left, the right-hand aperture 116*b* will move free of the cover portion 127*b* and into alignment with aperture 126*b*. In this position, the left-hand aperture 16*a* is still covered by cover portion 127*a*. By further movement of the second plate 121, this aperture 116*a* also moves free of its correspondent cover portion 127*a* and into alignment with aperture 126*a*. When this position has been reached, the total ventilating area provided by the aligned apertures 116 and 126 has arrived at its maximum value corresponding to the total area of the apertures 116. The operation of the ventilation device 100 is explained in further detail in the following with reference to FIGS. 20*a* to 20*c*.

Figure 20B:
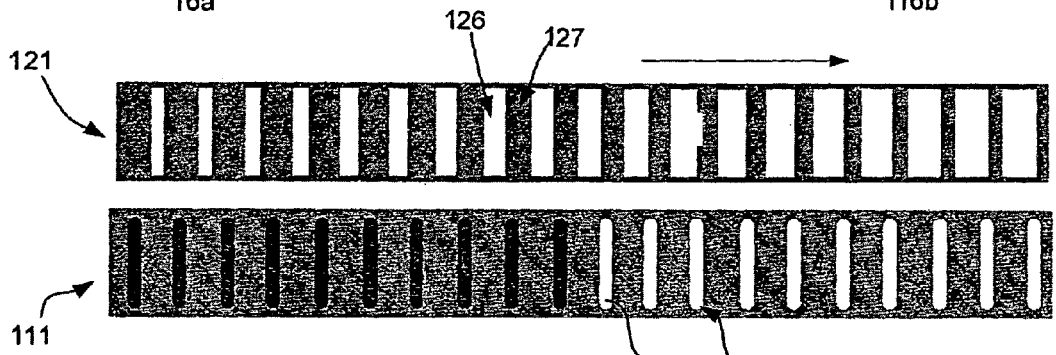
Figure 20C:
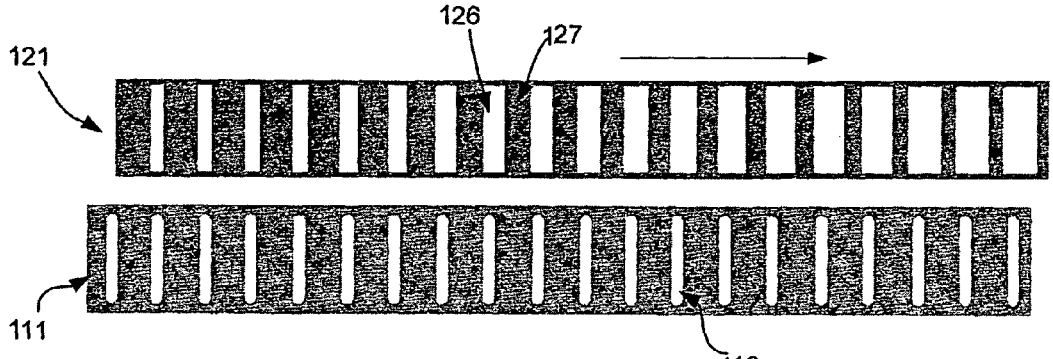

In FIGS. 20*a* to 20*c* the ventilation device 100 is positioned in a window or another building structure such that the first plate 11 is positioned toward the inside of the building, and light from the outside shines through any apertures 116 not covered by the cover sections 127 of the second plate 121.

At the upper parts of each of FIGS. 20*a* to 20*c* the second plate 121 is shown by itself. At the lower parts the first plate 111 is shown with the second plate 121 hidden behind it such that some apertures are blackened or dark depending on if they are covered by a cover portion 127. FIG. 20*a* shows the plates 111, 121 in a first extreme position in which the apertures 116 are not aligned with the apertures 126, i.e. ventilation through the apertures is substantially completely prevented. The plates 111,112 assume the first extreme position when the handle bar 36 is completely retracted.

As can be seen, the second plate 121 is in a position in relation to the first plate 111 in which none of the apertures 116 are aligned with the apertures 126, i.e. the cover portions 127 are aligned with and thus completely cover the apertures 116. All apertures 116 are thus blackened or dark in FIG. 20*a*.

In FIG. 20*b* the second plate 121 has been sled a small distance to the right in the figure in the direction of the arrow in order to assume an intermediate position. In this intermediate position about half the apertures 116 are at least partly out of alignment with the cover sections 127 such that they are now each aligned with one of the apertures 126. The other half are still out of alignment with the apertures 126. As was described above, even a small partly alignment of an aperture 116 with an aperture 126 will make the aperture 16 as light to the human eye as a complete alignment of the apertures 116, 126. This is the case for example of aperture 116*c* in FIG. 20*b*. A different easy-to-determine inter-mediate position and corresponding ventilating area is available for each aperture 116. Only small variations of the ventilating area exist for each of these intermediate positions. The first and second plates 111, 121 are in intermediate positions when the handle bar 36 is in between its retracted position and its intermediate position, with the ventilation device 100 gradually opening up more and more when the handle bar 36 is moved from its retracted position to its intermediate position and vice versa, whilst the window remains locked.

As shown in FIG. 20*c*, in the intermediate position of the handle bar 36 the second plate 121 has been sled a further distance in the direction of the arrow in order to assume the second extreme position. In this position all the apertures 116 are at least partly out of alignment with the cover sections 127 such that they are now each at least partly aligned with one of the apertures 126. The ventilating area and thus the air flow through the ventilation device 100 are thus at their highest in this position.

The apertures 116 have a small extent in the longitudinal direction x due to the above-described fact that only a small amount of light will make it appear as if an aperture is completely open.

When the handle bar is moved from its intermediate position to its extended position the ventilation device 100 remains in its second extreme position whilst the locking mechanism unlocks the window.

Preferably, the magnetic force is chosen to be greater than the gasket force in all positions of the sash; however, it may be determined that this may not always be so. With a magnetic force, where the gasket force L is larger at least at larger opening distances, another force, typically manual, would need to be applied to overcome the gasket force at least until the magnetic force becomes larger than the gasket force. Then, the magnetic force will be sufficient to hold the window in closed position.

As to ultimate uses, it may be noted that the window construction of the primary embodiments is a pivot window for installation in an inclined roof, however, the window or other aperture closure member may be installed in any of various orientations in/on a building, a vehicle or other situs for closing a respective aperture. Thus, a particular application of the assembly for securing is in doors for automobiles buses and lorries, which are typically provided with a resilient gasket that requires a substantial force to be compressed. Thus, the typical "slamming shut" of these type of doors can be avoided without the use of solenoids or electromotors as known from the prior art.

Preferably, the top, bottom and side members of the frame and sash structures may for the major part be built using wood products, although it is also possible to use metal or plastic. These profiles, particularly those which may be exposed to the weather may also be covered with covering members which are constituted of comparatively thin metal sheet profiles, for instance of aluminum, and which together may provide a completely weather-shielding enclosure of the window. Preferably the hinge(s) 9 and the operable securing/locking means 20 and/or 44 may be made from metallic material, such as steel, or strong plastic materials, such as fiber reinforced plastics or combinations thereof, the primary exceptions being the magnetic and/or magnetically activatable members which may be of magnetic materials. The handle bar assembly 36 may additionally and/or alternatively be made from various combinations of materials including, without limitation, wood, metals and/or plastics.

Although the present invention has been described in detail for purpose of illustration, it is understood that such detail is solely for that purpose, and variations and combinations can be made therein by those skilled in the art without departing from the scope of the appended claims.

The invention claimed is:

1. An assembly for securing a hinged building window (11) in a closed position relative to an aperture defined by a main frame (12), said assembly comprising:

said hinged building window (11), said main frame (12), a compressible gasket disposed between the hinged building window (11) and the frame (12) defining the aperture, wherein a magnetic means for securing said hinged building window (11) to the frame (12) includes a first portion and a second portion, wherein said magnetic means for securing includes a magnetic field in the first and second portions (50,54), the first portion (50) being disposed on the main frame (12) the second portion (54) being disposed on the hinged building window (11) and thus being adapted to be movable by an operator with the hinged building window alternately into a magnetically attractive closure position and a magnetically unattractive opening position, the gasket being at least partially compressed when the hinged building window (11) is secured to the aperture, and the attractive force between the portions (50, 54) exceeds the repulsion force of the gasket at all stages of compression of the gasket.

2. An assembly according to claim 1, wherein the first and second portions (50,54) are separated by a medium with a low magnetic permeability when the hinged building window 11 is in the closed position.

3. An assembly according to claim 1 wherein one or both of the portions (50,54) comprises a permanent magnet (51,55).

4. An assembly according to claim 3, wherein the permanent magnet (51,55) or the magnetic unit (50,54) is embedded in a material with a low magnetic permeability.

5. An assembly according to claim 4, wherein a medium with a low magnetic permeability separating the first and second portions is formed by the material in which the permanent magnet (51,55) or the magnetic unit (50,54) is embedded.

6. An assembly according to claim 1, wherein the permanent magnets (51,55) are bar magnets disposed on a substantially L-shaped member (52,56) of a magnetically permeable material to effectively form a U-shaped magnetic unit with both poles facing a common direction.

7. An assembly according to claim 1, further comprising a leverage mechanism for overcoming the attractive magnetic force between the first and second portions (50,54) when moving the hinged building window (11) away from the closed position.

8. An assembly according to claim 7, wherein the leverage mechanism includes a handle bar (36) operatively connected to a rotatable cam (48) and roller (61).

9. An assembly according to claim 8, wherein the leverage mechanism including the handle bar (36) and the cam (48) is arranged on the hinged building window (11).

10. An assembly according to claim 8, wherein the leverage mechanism includes a rack (65) and pinion (66) gear (38) to transmit a translative movement of the handle bar (36) into a rotational movement of the cam (48).

* * * * *